United States Patent [19]

Carnielli

[11] Patent Number: 4,625,551

[45] Date of Patent: Dec. 2, 1986

[54] DEVICE FOR DETECTING THE DEVELOPED POWER IN HOME PEDALLING APPARATUS FOR BICYCLES

[76] Inventor: Teodoro Carnielli, Via Dante, 61, Veneto (Treviso), Italy

[21] Appl. No.: 685,478

[22] Filed: Dec. 24, 1984

[30] Foreign Application Priority Data

Jun. 28, 1984 [IT] Italy ..... 22427/84[U]

[51] Int. Cl.[4] ..... A61B 5/22

[52] U.S. Cl. ..... 73/379; 272/73

[58] Field of Search ..... 73/379; 272/73, DIG. 5, 272/DIG. 6

[56] References Cited

U.S. PATENT DOCUMENTS 3,859,840 1/1975 Gause ..... 73/379

4,291,872 9/1981 Brilando et al. ..... 272/73

4,438,921 3/1984 Szymski ..... 272/73

FOREIGN PATENT DOCUMENTS 0013664 7/1980 European Pat. Off. ..... 272/73

*Primary Examiner*—Donald O. Woodiel

*Attorney, Agent, or Firm*—Bucknam and Archer

[57] ABSTRACT

The power detecting or sensing device to be applied to room pedalling apparatus or bicycles essentially comprises in a common envelope a tachometer and a revolving drum, thereon a colored pattern is defined controlled by a dynamometric braking caliper associated with the flywheel of the bicycle, the pointer of the tachometer and the pattern on the drum cooperating to indicate on a case patterned dial on the top of the envelope, for each speed of the bicycle, a respective value of the power applied by the user to cause the flywheel to rotate.

1 Claim, 6 Drawing Figures

DEVICE FOR DETECTING THE DEVELOPED POWER IN HOME PEDALLING APPARATUS FOR BICYCLES

BACKGROUND OF THE INVENTION

The present invention relates to an improved device for sensing or detecting the power applied by an user to a room pedalling apparatus or "bicycle".

As is known there are presently used, for therapeutical purposes, specifically designed tools or devices which essentially consist of bicycle structures, without wheels and supported by two pairs of forks.

Also known is the fact that the mentioned tools or implements comprise a pedalling assembly effective to drive a flywheel, through a chain transmission, said flywheel being braked according to the user needs.

The mentioned pedalling implements, in particular, are usually provided with a speedometer and optional odometer, which, as it should be apparent, is able of providing only a display about the revolving speed of the flywheel.

SUMMARY OF THE INVENTION

Accordingly, the task of the present invention is to overcome the above mentioned drawback, by providing a power detecting device, for room pedalling implements or apparatus, which is effective to instantaneously measure the power applied by the user to the pedals.

Within that task, it is a main object of the present invention to provide a power detecting or sensing device, for room or home pedalling implements, which may be read in an easy way and is reliable in its operation.

According to one aspect of the present invention, the above mentioned objects, as well as yet other objects, which will become more apparent thereinafter, are achieved by a power detecting or sensing device, effective to be applied to room or home pedalling apparatus according to the accompanying claim.

BRIEF DESCRIPTION OF THE DRAWINGS

Further characteristics and advantages of the power detecting device according to the present invention will become more apparent thereinafter from the following detailed description of preferred embodiments thereof, being illustrated, by way of an indicative but not limitative example, in the figures of the accompanying drawings, where.

DESCRIPTION OF A PREFERRED EMBODIMENT

Figure 1:
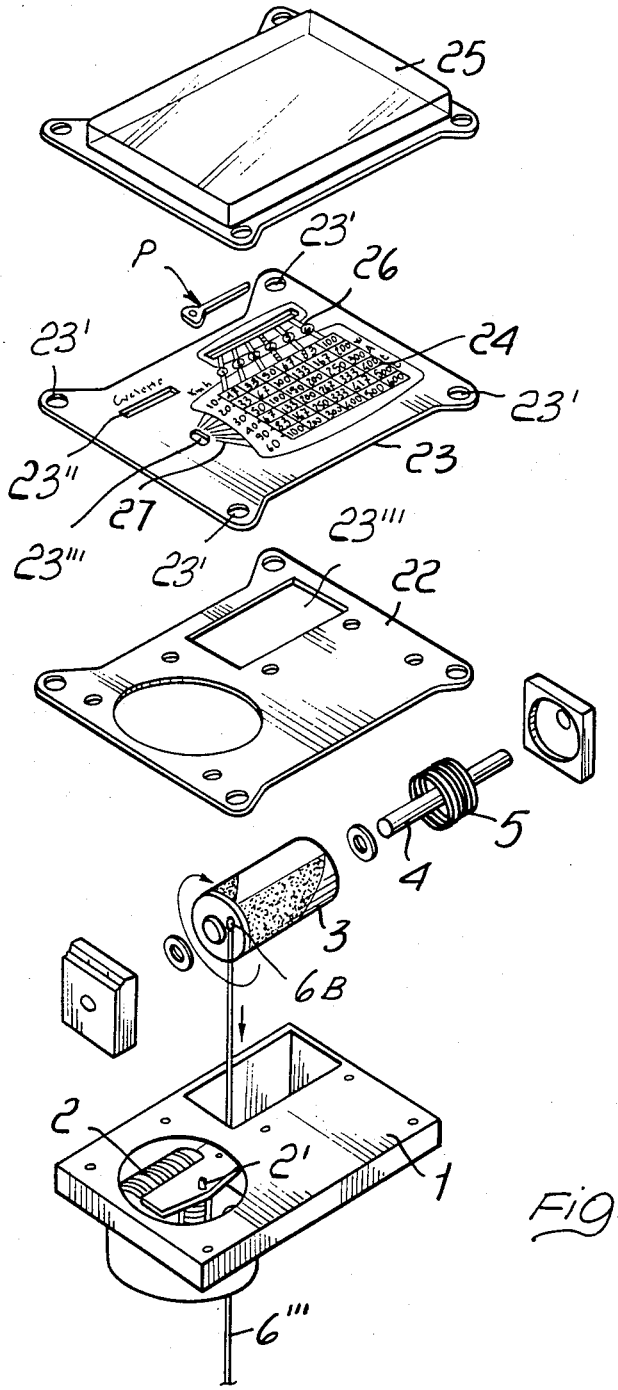
FIG. 1 is an exploded view illustrating the power detecting device according to the present invention.

With reference to the figures of the accompanying drawings, the power detecting device according to the present invention comprises a housing 1, preferably of a plastics material, effective to house a speedometer-odometer assembly 2 and a drum 3, the latter being mounted on a shaft the rotating movement whereof is counterbiased by a coil spring 5.

The rotation of the drum, thereon there is impressed a coloured pattern, helicoidally extending, is obtained, through an operating cable 6'', having metal or nylon inner wire 6''', by suitably adjusting a braking assembly or structure, generally indicated at BS, concentrical with the axis 7 of the flywheel 8, which flywheel is provided for clockwise rotation.

Figure 2:
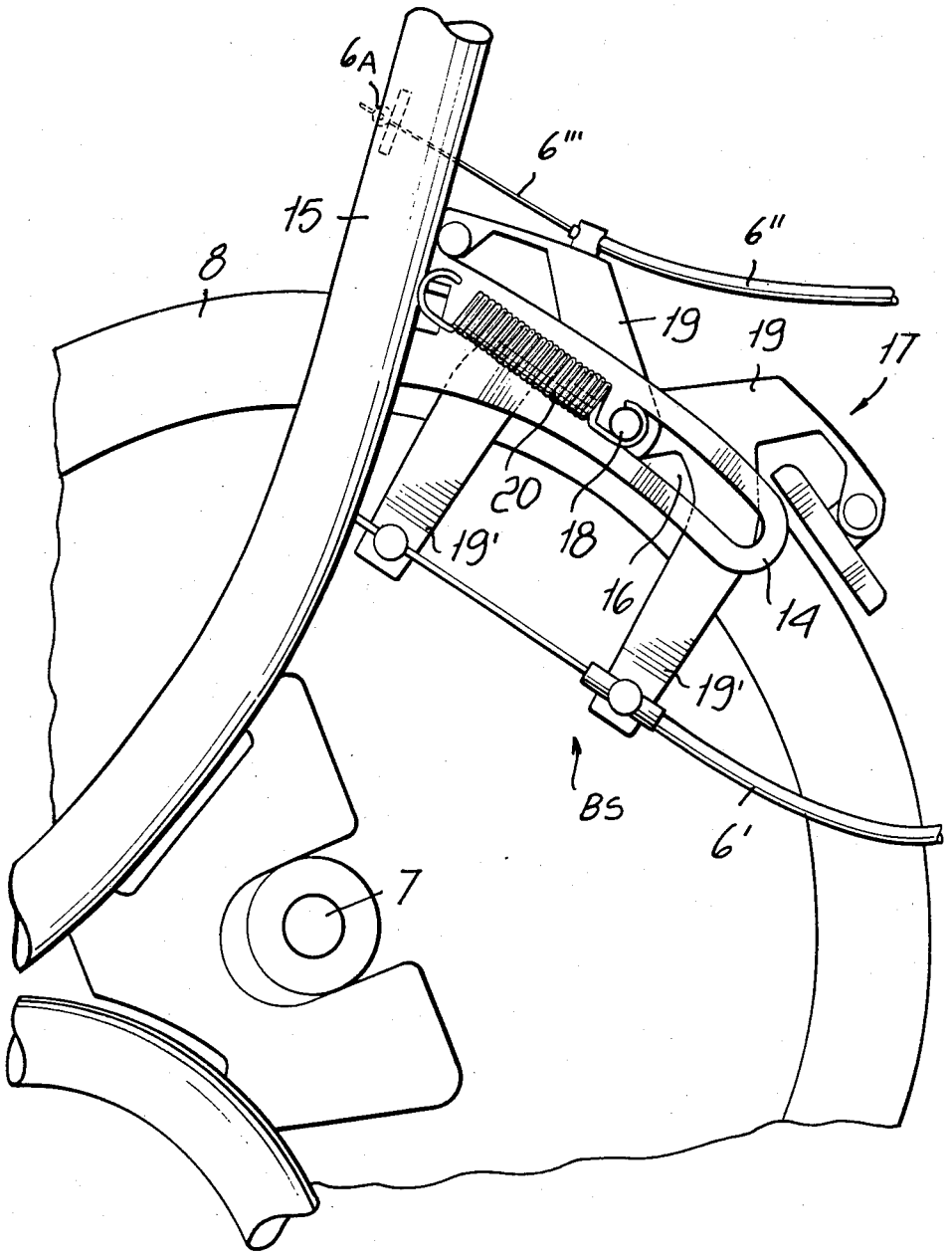
FIG. 2 is a perspective view illustrating a first possible embodiment of a braking assembly for operating the power detecting device according to the present invention, as mounted on the flywheel thereof in a first position thereof on said flywheel.
Figure 3:
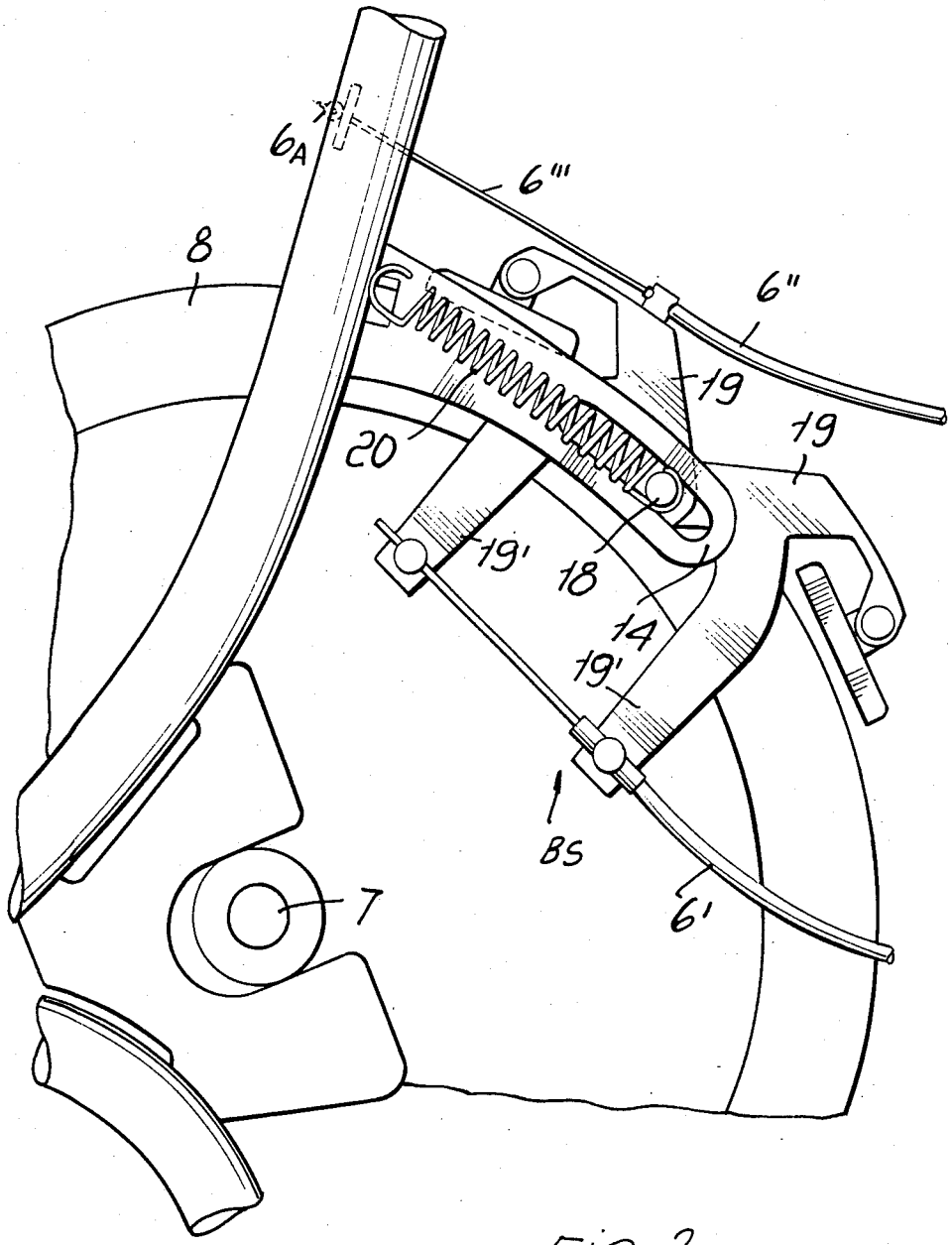
FIG. 3 is a perspective view illustrating the braking assembly of FIG. 2 in a second position thereof on the flywheel, which second position is displaced clockwise with respect to the first and corresponds to a greater braking power.
Figure 4:
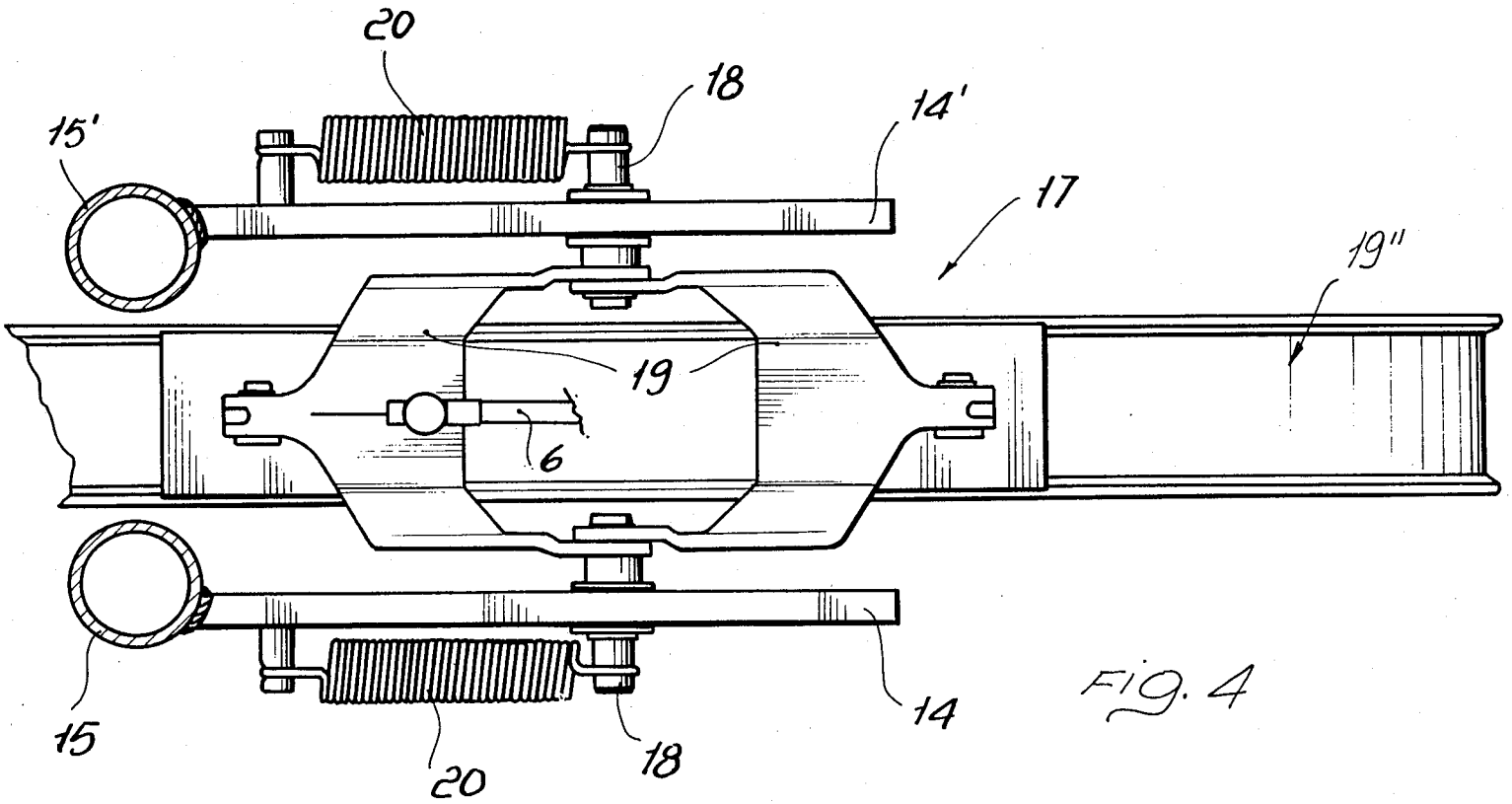
FIG. 4 is a top view of the mentioned braking assembly.

In a preferred embodiment shown in FIGS. 2 to 4, the mentioned braking assembly essentially comprises two brackets 14 and 14' which are rigid with the forks 15 and 15' bicycle frame.

The mentioned brackets are suitably slotted to provide corresponding guides 16, concentric with the flywheel axis, therealong a movable assembly 17, pivoted on an axle 18, is able of sliding.

The mentioned movable assembly 17 is provided with a braking caliper, including two braking shoes 19 provided for resting and pressing on the periphery of the flywheel 8, which, to this end is suitably peripherally grooved at 19' (see FIG. 4), said shoes 19 being counterbiassed by respective dynamometric spring 20.

More specifically, the adjusting of clamping of the braking shoes 19 on the flywheel is obtained through the mentioned cable 6'' which acts on the four arms 19' of the braking caliper.

In the preferred embodiment of the braking assembly shown in FIGS. 2 and 3, the adjustment of the shoe clamping force is obtained by operating a knob (not shown) arranged for example on the bicycle handle bar and the positions of which correspond to different running conditions (for example a flat or upward road surface) to be selected by the user. In particular, as the knob is rotated to cause the caliper arms 19' to approach, the caliper shoes 19 will be pressed with a greater force on the flywheel periphery, which will correspond, for example, to an uphill running.

In the meanwhile the caliper assembly will be displaced clockwise, the maximum displacement, which will correspond to the maximum braking force depending, as it should be apparent, on the longitudinal extensions of the slots formed in the brackets 14 and 14'.

Because of the provision of the mentioned dynamometric springs 20, the more will be the clockwise displacement of the caliper assembly, the greater will be the pressing force of the braking shoes on the flywheel groove and proportionately greater will be the power to be applied by the user to cause the flywheel to rotate with a given speed.

Likewise (as it is clearly shown in FIGS. 2 and 3) the greater is the power to be applied by the user the more will be displaced the sheath of the cable 6'', thereby withdrawing a greater amount of wire 6''' therefrom, since the wire 6''' has one end $6_A$ thereof fixed to the bicycle frame, and the other end $6_B$ fixed to the revolving drum 3. Thus the drum 3 will be rotated through a progressively greater angle in such a way that the helical pattern thereon will indicate cases on the instrument dial, which correspond to progressively greater powers applied by the user to the braked flywheel.

In the mentioned housing or envelope 1 there are arranged, at superimposed positions, as it is shown in FIG. 1, respectively a shaped plate 22, a dial 23, bearing a speed and power indicating table 24 and provided with suitable registering slots and a clear cover 25.

Figure 5:
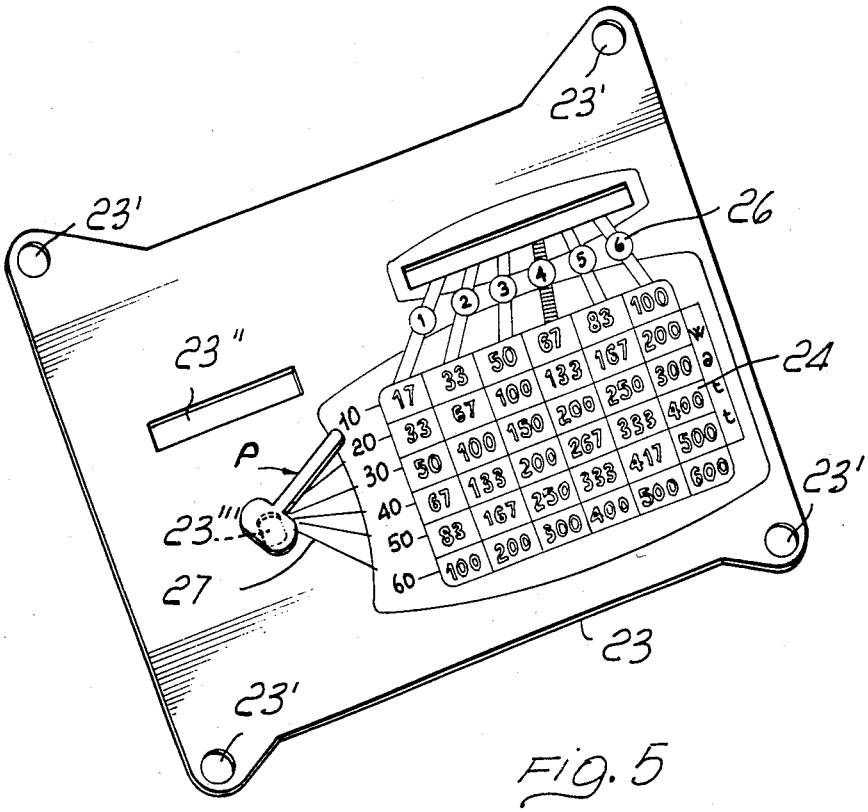
FIG. 5 is a detail view on an enlarged scale, of the dial of the device of FIG. 1 useful for understanding the operation of the power detecting or sensing device according to the invention.
Figure 6:
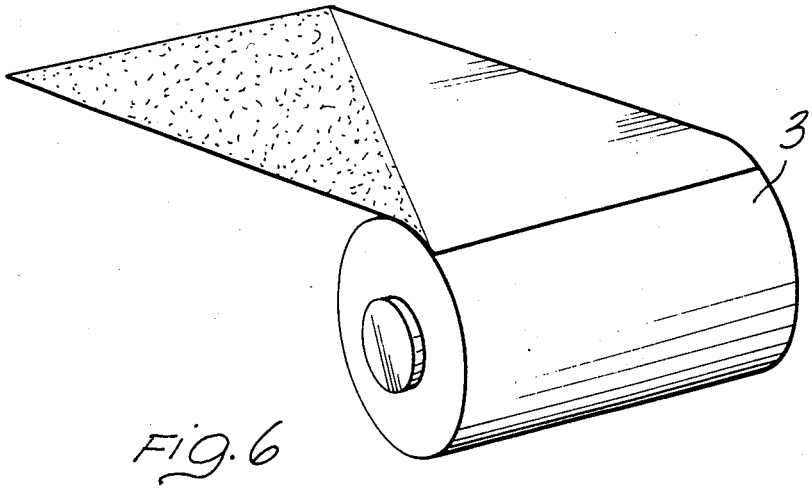
FIG. 6 is a detail view illustrating a possible embodiment of a revolving patterned drum included in the subject power detecting device.

With reference to FIG. 5, the dial 23 comprises a substantially rectangular sheet member 23 provided, at the corners, with registering holes 23' a first rectangular slot 23'' for displaying the kilometers, and a second rectangular slot 23''' for displaying a portion of the pattern on the revolving drum 3, which portion will depend, as it should be apparent, on the rotation angle of said drum, which is rotated proportionately to the clockwise displacement of the braking shoes 19 on the grooved periphery of the flywheel 8, through the inner wire 6''' of the cable 6''.

Moreover a further slot 23'''' is provided for allowing for the pin 2' of the assembly 2 to pass therethrough, said pin being provided for supporting the speed pointer P of the assembly 2 itself.

More specifically, on the top surface of the sheet member 23 there is defined the mentioned table 24 consisting of a plurality of watt's indicating cases in each of which there is written a respective number indicating depending on the speed, the power (in watts) developed by the bicycle user.

A possible arrangement of this table, as shown in FIG. 5 comprises six columns each whereof formed by six numbers, that is

| | | | | | |
|---|---|---|---|---|---|
| 17 | 33 | 50 | 67 | 83 | 100 |
| 33 | 67 | 100 | 133 | 167 | 200 |
| 50 | 100 | 150 | 200 | 250 | 300 |
| 67 | 133 | 200 | 267 | 333 | 400 |
| 83 | 167 | 250 | 333 | 417 | 500 |
| 100 | 200 | 300 | 400 | 500 | 600 |

A further column of six numbers (10, 20, 30, 40, 50; 60) is arranged before the left most column, each number of said further column being indicative of a respective speed indicated by the pointer P. A plurality of slanted coloured strip paths, each indicated by a respective circled number lead from the drum pattern slot 23''' to the head numbers of the six first mentioned columns. The coloured pattern of the drum will be such as to point to a well defined strip path, depending on the drum 3 rotation angle, that is depending on the clockwise displacement of the caliper shoes 19 on the grooved periphery of the flywheel 8: in the meanwhile the pointer P, depending on the speed will indicate a number of the last mentioned column. For example if the pointer P indicates 10 and the pattern on the drum (the right edge of said pattern defining substantially a line) indicates 2, then the table will provide a read out of 33 watts; if the pointer P indicates 40 (kms/h) and the pattern the strips 6, then the read out will be 400 watts and so on.

Obviously the pointer P will be driven through another cable, not specifically shown, to be coupled, as is conventional, for example to the flywheel axis.

It should of course be noted that the above mechanical embodiment of the system according to the present invention may also be changed to an electrical embodiment by replacing, for example, the mechanical drive with an electrical wire and by using potentiometers and solenoids for the read out operation or detecting operation of the movements of the mentioned braking assembly.

While a preferred embodiments of the improved device for detecting the developed power, effective to be applied to a home pedalling apparatus has been therein disclosed, it should be noted that it is suceptible to several modifications and variations all of which come within the scope of the invention.

I claim:

1. A power detecting device to be applied to room pedalling apparatus, essentially comprising, in a common envelope, a tachometer and a revolving drum, provided with a colored pattern thereon and driven by a dynamometric braking caliper assembly associated to the flywheel of said pedalling apparatus, the pointer of said tachometer and said colored pattern on the drum being so designed as to indicate in cooperation a case of a table including a plurality of said cases therein there is written a respective number indicative of said power, said braking caliper assembly essentially comprising two brackets rigid with the bicycle frame and providing corresponding guides, concentrical with the axis of the flywheel, therealong said caliper assembly is able of sliding, said caliper assembly being provided with braking shoes arranged to friction contact the top grooved peripheral portion of said flywheel, said shoes causing, as they are clamped on said flywheel periphery, said braking caliper assembly to advance against the progressive biassing of two dinamometric springs, said revolving drum being coupled to said caliper assembly through the inner wire of a driving cable.

* * * * *